US005603214A

United States Patent [19]

Abels et al.

[11] Patent Number: 5,603,214

[45] Date of Patent: Feb. 18, 1997

[54] EXHAUST SYSTEM FOR AN INTERNAL COMBUSTION ENGINE AND METHOD OF OPERATION THEREOF

[75] Inventors: Theodor Abels, Aschaffenburg; Siegfried Iwanowski, Haibach, both of Germany

[73] Assignee: Linde Aktiengesellschaft, Hollriegelskreuth, Germany

[21] Appl. No.: 431,621

[22] Filed: May 1, 1995

Related U.S. Application Data

[63] Continuation of Ser. No. 188,028, Jan. 28, 1994.

[30] Foreign Application Priority Data

Jan. 29, 1993 [DE] Germany ..... 43 02 519.6

[51] Int. Cl.[6] ..... F01N 7/00; B05B 1/00

[52] U.S. Cl. ..... 60/273; 60/324; 239/571

[58] Field of Search ..... 60/324, 272, 273; 239/571, 533.13

[56] References Cited

U.S. PATENT DOCUMENTS

| | | | |
|---|---|---|---|
| 733,330 | 7/1903 | New | 181/278 |
| 1,163,128 | 12/1915 | Brauer | 181/278 |
| 1,465,904 | 8/1923 | Herdle | 181/258 |
| 1,483,354 | 2/1924 | Kopper, Jr. | 181/236 |
| 1,693,910 | 12/1928 | Richardson et al. | 60/324 |
| 2,570,509 | 10/1951 | Bandli | 60/324 |
| 3,002,269 | 10/1961 | Hopkins | 29/441.1 |
| 3,234,924 | 2/1966 | May | 60/324 |
| 3,446,010 | 5/1969 | Hopkins | 60/324 |
| 3,870,083 | 3/1975 | Nezat | 138/45 |
| 3,969,895 | 7/1976 | Krizman | 60/324 |
| 4,699,244 | 10/1987 | Bergquist | 181/226 |
| 4,903,486 | 2/1990 | Finkle | 60/324 |
| 4,970,859 | 11/1990 | Yates et al. | 60/324 |
| 5,279,117 | 1/1994 | Kaiser | 60/324 |
| 5,355,673 | 10/1994 | Sterling et al. | 60/324 |

FOREIGN PATENT DOCUMENTS

| | | | |
|---|---|---|---|
| 0097387 | 1/1984 | European Pat. Off. | F16K 1/20 |
| 0195762 | 9/1986 | European Pat. Off. | F01N 1/16 |
| 3013512 | 10/1981 | Germany | F01N 7/20 |
| 3432195 | 3/1986 | Germany | F01N 7/20 |

OTHER PUBLICATIONS

French Search Report, Nov. 24, 1994, 1 page.

*Primary Examiner*—Denise L. Gromada
*Assistant Examiner*—L. Heyman
*Attorney, Agent, or Firm*—Webb Ziesenheim Bruening Logsdon Orkin & Hanson P.C.

[57] ABSTRACT

An exhaust system for an internal combustion engine including an exhaust duct having a lower portion and an upper portion with a discharge outlet. A pivotable flap is located in the upper portion of the exhaust duct to influence the discharge rate of the exhaust gases passing through the discharge outlet to provide a high rate of discharge of the exhaust gases independently of the operating speed of the internal combustion engine.

18 Claims, 3 Drawing Sheets

EXHAUST SYSTEM FOR AN INTERNAL COMBUSTION ENGINE AND METHOD OF OPERATION THEREOF

This is a continuation of copending application Ser. No. 08/188,028 filed on Jan. 28, 1994.

BACKGROUND OF THE INVENTION

1. Field of the Invention

The invention relates generally to an exhaust system for an internal combustion engine, and more particularly, to an arrangement for adjusting the size of the discharge outlet of such an exhaust system and the method of carrying out the adjustment in accordance with the speed of the engine.

The operation of internal combustion engines is presently optimized so as to control the composition of the exhaust gases to reduce environmental pollution. In this regard, the exhaust systems of internal combustion engines are provided with devices such as particulate filters and catalytic converters for treating the exhaust gases. Favorable results have been attained when these devices are used with internal combustion engines operating at a constant speed in substantially constant environmental conditions.

However, a dangerous condition is created when personnel are required to remain in the immediate vicinity of the exhaust gas discharge outlet of the exhaust system for extended periods. This can occur, for example, in connection with a forklift truck powered by an internal combustion engine, and with construction equipment and similar vehicles. In these situations, a significant concentration of the exhaust gases can occur in the general vicinity of the vehicle operator which becomes particularly harmful when the vehicle is travelling at slow speeds and when the vehicle is stationary. In addition to creating a health hazard, the hot exhaust gases and the particulates in the exhaust gases which are produced by diesel engines are a considerable nuisance, in addition to being a health hazard for the vehicle operator. In such operating conditions, as little as a quarter of the nominal power of the internal combustion engine may be utilized, which creates a particularly unfavorable composition of the exhaust gases. In addition, due to the low engine speed, the exhaust gases exit the discharge outlet of the exhaust system at a relatively low velocity, which increases the concentration of the exhaust gases in the general vicinity of the discharge outlet and thus in the vicinity of the vehicle operator.

Consequently, on various conventional forklift trucks the discharge outlet for the exhaust system is located high up, toward the rear on the right-hand side of the truck in the direction of travel. In spite of this location of the discharge outlet for the exhaust gases, measurements show that the concentration of harmful exhaust gas components is significantly higher at the level of the vehicle operator's head than is found on average in the ambient air. This is true for the operation of a vehicle in a closed building and for the operation of a vehicle in the open. This problem also exists in the operation of construction equipment and with stationary internal combustion engines in operating conditions in which the speed of the internal combustion engine varies and the operator remains in the vicinity of the stationary engine.

2. Summary of the Invention

The object of the invention is to provide an arrangement for an exhaust system for an internal combustion engine which reduces the concentration of harmful exhaust gases in the vicinity of the discharge outlet of the exhaust gas system.

This object is achieved according to one embodiment of the invention by locating a device in the exhaust system which causes the exhaust gases to exit the system at a speed which is independent of the speed of operation of the internal combustion engine which produces the exhaust gases. Accordingly, an essential aspect of the invention is to obtain the highest possible discharge speed for the exhaust gases at all engine speeds and loads so that the exhaust gases are distributed as far from the discharge outlet of the exhaust gas system as is possible. In the past a relatively high exhaust gas discharge speed has only been achieved when the internal combustion engine is operating at nominal speed (full load), whereas according to the invention this is now possible at all engine operating speeds. Consequently, the concentration of harmful exhaust gases at the discharge outlet of the exhaust gas system in the vicinity of the operator is significantly reduced.

In carrying out the invention, the cross section of the discharge outlet of the exhaust gas system is automatically adjusted in accordance with the volume of exhaust gases being produced by an internal combustion engine. Thus, the cross section area of the discharge outlet is increased when the quantity of exhaust gases is increased and the cross section area of the discharge outlet is decreased when the quantity of exhaust gases is decreased. Accordingly, the exhaust gas discharge speed is influenced by changing the cross section area of the discharge outlet of the exhaust gas system. The cross section area of the discharge outlet is normally such that when the internal combustion engine is under high load, i.e., maximum engine speed and high exhaust gas temperature, a certain exhaust gas back pressure occurs and a high exhaust gas outlet speed is obtained. In a conventional exhaust system, the cross section area of the discharge outlet is constant, and when the speed of the internal combustion engine decreases, the exhaust gas back pressure and thus the exhaust gas outlet speed decreases. This is prevented in the present invention because the cross section area of the discharge outlet is automatically decreased when the quantity of exhaust gases decreases. This means that the exhaust gas back pressure is substantially maintained and consequently the exhaust gas outlet speed remains relatively high. The intent is to ensure that the outlet speed of the exhaust gases drops by only a relatively small amount so that the exhaust gases do not concentrate at the discharge outlet of the exhaust system.

According to the invention, a device is located in the end portion of the exhaust gas system to maintain the outlet speed of the stream of exhaust gases relatively high independently of the speed of the internal combustion engine. The device in the end portion of the exhaust system which determines the cross section area of the discharge outlet is influenced by an external closing force or an external closing moment to urge the device in the closing direction to reduce the discharge outlet cross section area and by an external opening force or opening moment which is created by the quantity of exhaust gases to urge the device in the opening direction to increase the discharge outlet cross section area.

The device according to the invention consists of an eccentrically mounted pivotal flap which has one elongated face exposed to the stream of exhaust gases and which forms one wall of the end portion of the duct of the exhaust system. The flap is pivotable about an axis located at a right angle to the direction of flow of the exhaust gases through the upper portion of the exhaust system. The flap cooperates with the static walls of the end portion of the duct of the exhaust system to form a nozzle-shaped flow path having a decreasing cross section area. The flap is mounted to pivot between a first closing position wherein the discharge outlet has a small cross section area which is preceded by a continuous sharply decreasing cross section area in the upper portion of the duct, and a second opening position wherein the discharge outlet has a large cross section area which is preceded by a continuous gently converging or a substantially constant cross section in the upper portion of the duct. Such a device is easily and inexpensively installed and permits reliable operation with relatively low costs.

The back pressure of the exhaust gases consists of a static component and a dynamic component. As the pivotably mounted flap gradually opens, the effect of the dynamic component on the surface of the flap is reduced. Provided the closing force on the flap is constant, the back pressure of the exhaust gases in the exhaust gas system increases and, thus, affects the exhaust gas components. For example, if the internal combustion engine is a diesel engine, the amount of particulates in the exhaust gases is increased. To counteract this increase, it is expedient if the closing force or the closing moment on the flap is variable so that the closing force or the closing moment decreases as the cross section area of the discharge outlet increases. As a result, the opening of the flap takes place at roughly constant exhaust gas back pressure.

Particularly favorable flow conditions are obtained if the upper portion of the exhaust gas system in which the flap is located has a substantially rectangular or oval-shaped cross section having a major dimension and a minor dimension. The cross section of the discharge outlet has its major dimension aligned with the direction of movement of the flap when the flap is completely opened, and its minor dimension so aligned when the flap is in the position creating the smallest possible discharge outlet cross section area. This results in a cross section having a shape approximating a circle over a large range of openings, which is particularly suitable for concentrating the exhaust gases from the flow standpoint.

According to another embodiment of the invention, the upper portion of the exhaust duct of the exhaust system is pivotably connected to the remainder of the exhaust duct of the exhaust gas system. This is advantageous because physical restrictions, such as overhead beams and pipes or the like, exist in many areas where working vehicles operate and can interfere with the flow of the stream of exhaust gases. Some closed buildings also have smoke detectors which are affected by direct contact with exhaust gases. In such cases, it is desirable to direct the stream of exhaust gases in a specific direction to reduce the concentration of exhaust gases by pivoting the upper portion of the exhaust duct in an appropriate direction.

The use of the method according to the invention and the use of the arrangement in the exhaust system according to the invention with an internal combustion engine for a mobile working vehicle, in particular an industrial truck, is particularly advantageous.

A complete understanding of the invention will be obtained from the following description when taken in connection with the accompanying figures of drawings wherein the like reference characters identify like parts throughout.

DESCRIPTION OF THE PREFERRED EMBODIMENTS

Figure 1:
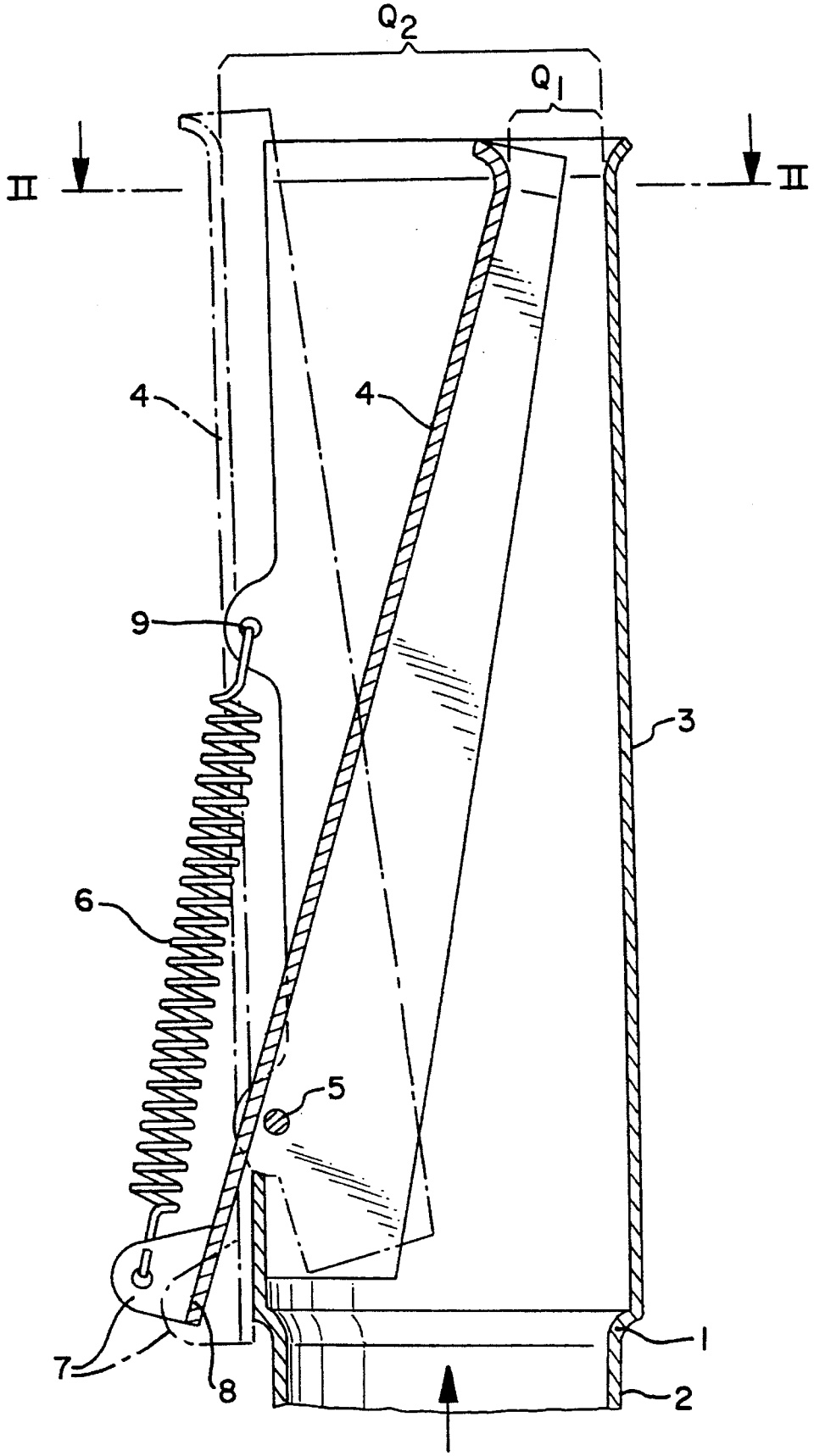
FIG. 1 is a longitudinal section through the discharge end of an exhaust duct.

The discharge end of an exhaust duct for an internal combustion engine is shown in FIG. 1 of the drawings. The discharge end has a lower portion 2 with a cylindrical cross section and an upper portion 3 with a substantially oval cross section. The upper and lower portions are connected by a transition section 1. The direction of flow of the exhaust gases through the exhaust duct is symbolized by the upwardly directed arrow in lower portion 2. A part of the duct wall in upper portion 3 is formed by a flap 4 which is pivotally mounted on a substantially horizontal pivot pin 5 and has the surface of one side exposed to the stream of exhaust gases flowing through the upper portion of the exhaust duct. Pivot pin 5 is located transverse to the direction of flow of the exhaust gases along the exhaust duct. The position of flap 4 relative to the stationary walls of upper portion 3 of the discharge end of the exhaust duct determines the extent to which the cross section area within the upper portion of the discharge end of the exhaust duct tapers toward the discharge outlet and also determines the cross section area of upper portion 3 of the exhaust system. This cross section area can vary from a minimum represented by $Q_1$, to a maximum represented by $Q_2$ with intermediate outlet cross section areas between $Q_1$ and $Q_2$.

When the internal combustion engine is idling or is operating at a low load and a low speed, a pair of tension springs 6 bias flap 4 into the position shown in solid lines in FIG. 1 of the drawings, resulting in a discharge outlet having the smallest possible cross section area $Q_1$. One end of each tension spring 6 is fixed in a hole in a lug 7 on an outrigger 8 of flap 4. The other end of each tension spring 6 is fixed in a hole 9 in a lug on a stationary sidewall of upper portion 3 of the exhaust duct. This allows exhaust gas back pressure to build up inside the exhaust system to a level which is roughly the same or only slightly lower than the exhaust gas back pressure which exists when the internal combustion engine is operating at full speed. Consequently, the exhaust gases leave the discharge outlet of the exhaust system at a high speed even when the internal combustion engine is operating at a low speed, so that the concentration of exhaust gases does not build up in the immediate vicinity of the discharge outlet of upper portion 3 of the exhaust duct.

As the speed of the internal combustion engine increases, the quantity of exhaust gases produced per unit of time and thus the back pressure of the exhaust gases also increases. The back pressure of the exhaust gases exerts a force on the exposed inner surface of flap 4 which opposes the force of tension springs 6 and flap 4 starts to pivot about pivot pin 5 against the force of the tension springs to increase the cross section area of the discharge outlet.

The back pressure of the exhaust gases consists of a static component and a dynamic component. As flap 4 gradually opens, the action of the dynamic component on the surface of flap 4 decreases. Additionally, as the load of the internal combustion engine increases, pressure losses increase in the silencer of the exhaust system so that the exhaust gas back pressure in upper portion 3 of the exhaust duct no longer increases to the original extent. On the other hand, during opening of flap 4 tension springs 6 are extended downwardly which increases the spring force counteracting the exhaust gas back pressure and tends to close the flap. In order to offset the increased spring force and to prevent the back pressure of the exhaust gases from increasing excessively in the exhaust system as a whole, which would have unfavorable effects on the exhaust gas components (such as for example the formation of particulates when the internal combustion engine is a diesel engine), the lugs 7 are located on flap 4 to reduce the effective leverage of springs 6 as the flap progressively opens by varying the distance between the axis of pivot pin 5 and the center line of springs 6. This reduces the closing moment.

The fully opened position of flap 4 shown in the dash-dotted lines in FIG. 1 of the drawings produces the maximum discharge outlet cross section area $Q_2$, which is matched to the maximum load of the internal combustion engine. The maximum closed position of flap 4 shown by solid lines produces the smallest possible cross section area, $Q_1$, of the discharge outlet. In the intermediate positions flap 4 together with the remaining walls of upper portion 3 of the exhaust duct form a convergent nozzle-shaped upper portion.

Figure 2:
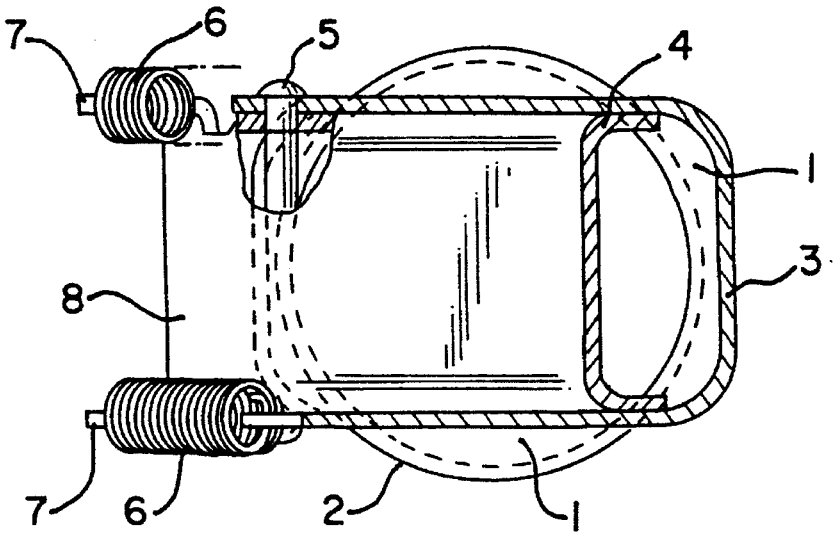
FIG. 2 is a section on line II—II in FIG. 1.

FIG. 2 of the drawings shows a section of upper portion 3 on line II—II of FIG. 1. Immediately above transitional area 1, in the direction of flow of the exhaust gases, the cross section of upper portion 3 of the exhaust duct has the general shape of an oval having the shorter dimension parallel with the axis of pivot pin 5. When flap 4 is fully opened, as shown in dash-dotted lines in FIG. 1 of the drawings, the entire length of upper portion 3 of the exhaust duct has a substantially constant cross section. When flap 4 is in the closed position, as shown in solid lines in FIG. 1 of the drawings, the cross section of the discharge outlet has the form of a substantially transverse oval, i.e., an oval such as shown in FIG. 2 of the drawings. The oval has the longer dimension parallel to the axis of pivot pin 5.

Figure 3:
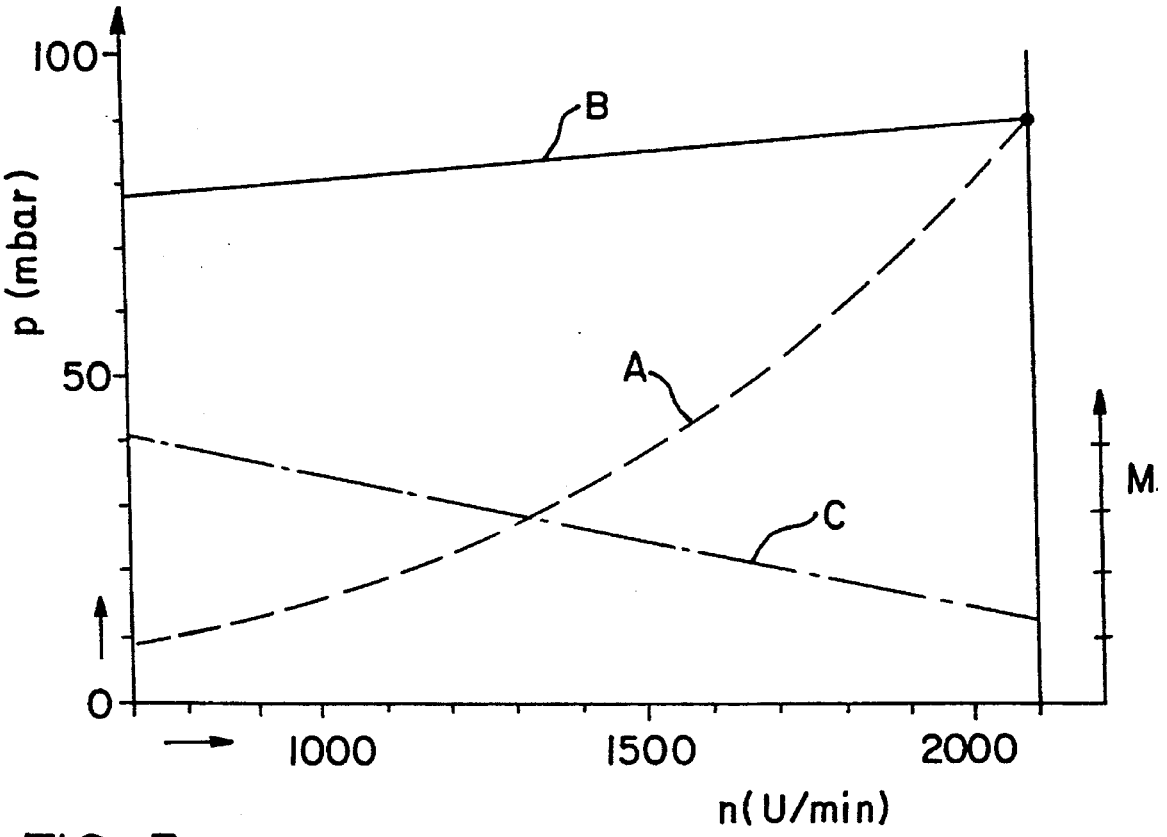
FIG. 3 is a plot of exhaust gas pressure versus engine speed.

The graph shown in FIG. 3 of the drawings plots the relationship between the speed of the internal combustion engine; the exhaust gas back pressure in the upper portion of the exhaust system and the closing moment on flap 4. The speed of the internal combustion engine in revolutions per minute (n[u/min]) is plotted along the abscissa. The left-hand ordinate represents the exhaust gas back pressure, (p[mbar]), and the right-hand ordinate represents the operating moment, (M), required to open flap 4. Dotted line curve A shows the back pressure of the exhaust gases versus the engine speed in a conventional exhaust system. According to curve A, as the speed, n, of the internal combustion engine increases, the exhaust gas back pressure, p, also increases as a function of the square of the engine speed with a slight dependence on the temperature of the exhaust gases. When an exhaust system with a variable discharge outlet cross section area according to the invention is used, the relationship between the exhaust gas back pressure, p, and the speed, n, of the internal combustion engine is as shown by solid line curve B. Here, a high exhaust gas outlet speed is obtained over the entire range of engine speeds. Expediently, a slight drop in exhaust gas back pressure should be allowed as the engine speed falls so that the permissible limit is only reached in the end region at the maximum outlet cross section area. The dash-dotted line curve C shows the decreases in the moment which is required to open flap 4 as the engine speed increases.

Figure 4:
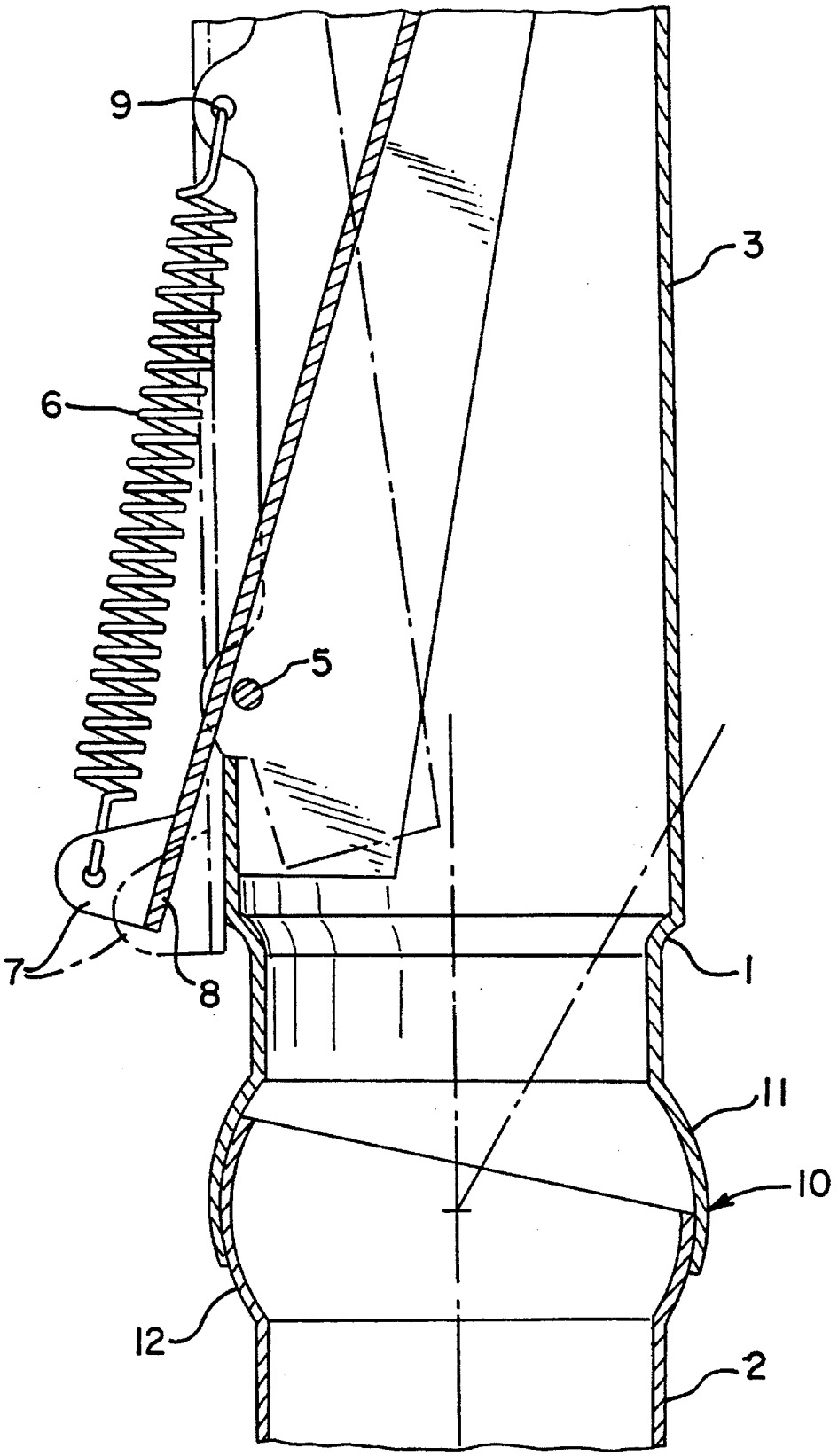
FIG. 4 is a longitudinal section through the discharge end of an exhaust duct according to a second embodiment of the invention.

In the embodiment of the invention shown in FIG. 4 of the drawings, upper portion 3 of the exhaust duct is pivotally connected to lower cylindrical portion 2 to direct the exhaust gases away from the discharge outlet. The pivotable connection 10 between lower cylindrical portion 2 of the exhaust duct and upper portion 3 of the exhaust duct is a ball and socket type joint having an outer rounded socket portion 11 formed on the lower end of upper portion 3 below transition area 1 and an inner rounded ball portion 12 formed on the upper end of lower cylindrical portion 2. A flexible corrugated bellows type joint may also be used to pivotally connect upper portion 3 to lower portion 2.

The foregoing describes preferred embodiments of the invention and is given by way of example only. The invention is not limited to any of the specific features described herein, but includes all such variations thereof within the scope of the appended claims.

We claim:

1. An exhaust duct for exhaust gases discharged from an internal combustion engine, said exhaust duct having a first portion with an inlet end and an outlet end and a second portion with an inlet end in flow communication with said outlet end of said first portion and a distal end, said distal end having means forming an adjustable nozzle-shaped discharge outlet having rounded corners for exhaust gases, and adjustment means for said means forming said adjustable nozzle-shaped discharge outlet to vary the cross section area of said adjustable nozzle-shaped discharge outlet, whereby said adjustment means operates to pass the exhaust gases through said adjustable nozzle-shaped discharge outlet at a high discharge velocity independently of the operating speed of the internal combustion engine providing the exhaust gases.

2. An exhaust duct as set forth in claim 1 having a longitudinal axis, wherein said means forming said adjustable nozzle-shaped discharge outlet includes a plurality of stationary walls, fixed pivot means extending between a pair of said stationary walls located approximately at a right angle to said longitudinal axis of said exhaust duct for mounting an adjustable pivot member, an adjustable pivot member mounted on said fixed pivot means and forming a wall of said adjustable nozzle-shaped discharge outlet, and means for moving said adjustable pivot member relative to said plurality of stationary walls, whereby said adjustable pivot member forms a moveable wall of said means forming said adjustable nozzle-shaped discharge outlet of said exhaust duct and said adjustable pivot member and said plurality of stationary walls form said adjustable nozzle-shaped discharge outlet having a variable cross section area.

3. An exhaust system as set forth in claim 2 wherein said second portion of said exhaust duct has a plurality of stationary walls and said adjustable pivot member is an eccentrically mounted flap located in said second portion of said exhaust duct to form one boundary for the exhaust gases flowing through said exhaust duct, whereby said flap forms a moveable wall of said second portion of said exhaust duct and said flap and said plurality of walls of said second portion of said exhaust duct form said adjustable nozzle-shaped discharge outlet having a variable cross section area in said second portion of said exhaust duct.

4. An exhaust system as set forth in claim 3 including variable force means connected between said flap and one of said plurality of stationary walls for exerting a pivoting force on said flap to decrease said cross section area of said discharge outlet, whereby said pivoting force decreases as the cross section area of said discharge outlet increases.

5. An exhaust system as set forth in claim 4 wherein said second portion of said exhaust duct has a substantially oval cross section and the maximum cross section area of said discharge outlet has its major dimension aligned with the direction of movement of said adjustable pivot member and the minimum cross section area of said discharge outlet has its major dimension perpendicular to the direction of movement of said adjustable pivot member.

6. An exhaust system as set forth in claim 3 wherein said second portion of said exhaust duct has a substantially oval cross section and the maximum cross section area of said discharge outlet has its major dimension aligned with the direction of movement of said adjustable pivot member and the minimum cross section area of said discharge outlet has its major dimension perpendicular to the direction of movement of said adjustable pivot member.

7. An exhaust duct as set forth in claim 1 wherein said means forming said adjustable nozzle-shaped discharge outlet includes a fixed pivot member in said second portion of said exhaust duct and said means forming said adjustable nozzle-shaped discharge outlet is an external means pivotally attached to said fixed pivot member in said second portion of said exhaust duct to provide a small cross section area of said discharge outlet and a large cross section area of said discharge outlet in response to the quantity of exhaust gases passing through said exhaust duct from the internal combustion engine.

8. An exhaust system as set forth in claim 7 wherein said second portion of said exhaust duct has a substantially oval cross section and the maximum cross section area of said discharge outlet has its major dimension perpendicular to said fixed pivot member and the minimum cross section area of said discharge outlet has its major dimension aligned with said fixed pivot member.

9. An exhaust system as set forth in claim 1 wherein said second portion of said exhaust duct has a substantially oval cross section and the maximum cross section area of said discharge outlet has its major dimension aligned with the direction of movement of said means forming said adjustable nozzle-shaped discharge outlet and the minimum cross section area of said discharge outlet has its major dimension perpendicular to the direction of movement of said means forming said adjustable nozzle-shaped discharge outlet.

10. An exhaust system as set forth in claim 1 including pivot joint means located between said first portion of said exhaust duct and said second portion of said exhaust duct for pivotally connecting said first portion of said exhaust duct to said second portion of said exhaust duct, whereby exhaust gases exiting from said adjustable nozzle-shaped discharge outlet are directed in a desired direction by pivoting said second portion of said exhaust duct relative to said first portion of said exhaust duct to locate said discharge outlet in a desired direction.

11. An exhaust system as set forth in claim 1 wherein said second portion of said exhaust duct has a stationary wall section with a channel shape including a web with longitudinal edges and two substantially parallel sidewalls connected to said longitudinal edges of said web by said rounded corners and said means forming an adjustable nozzle-shaped discharge outlet is a pivoted flap mounted to extend between said substantially parallel sidewalls of said stationary wall section and spaced from said web of said stationary wall section to form a moveable wall of said exhaust duct in cooperation with said web and said sidewalls, said pivoted flap being pivotal between a first position inclined with respect to said web and a second position substantially parallel to said web, whereby said adjusting means for said means forming an adjustable nozzle-shaped discharge outlet resiliently biases said pivoted flap toward said first position to provide a convergent shape of said second portion of said exhaust duct.

12. An exhaust system as set forth in claim 11 wherein the width of said sidewalls is greater than the width of said web.

13. An exhaust system as set forth in claim 11 wherein said flap has a free end and said free end is spaced from said web by a distance less than the width of said web in said first position.

14. A method of operating an exhaust system having a variable discharge outlet for exhaust gases created by an internal combustion engine, said method including constantly adjusting the cross section area of said variable discharge outlet in accordance with the flow rate of the exhaust gases from the internal combustion engine to obtain a relatively high discharge velocity of exhaust gases from said variable discharge outlet independently of the operating speed of the internal combustion engine providing the exhaust gases.

15. A method according to claim 14 including automatically adjusting the cross section area of said variable discharge outlet of said exhaust system in accordance with the flow rate of said exhaust gases by increasing said cross section area of said variable discharge outlet in response to a high flow rate of said exhaust gases and decreasing said cross section area of said variable discharge outlet in response to a lower flow rate of said exhaust gases, whereby said relatively high velocity of the exhaust gases discharged from said variable discharge outlet is maintained substantially constant.

16. An exhaust duct for exhaust gases discharged from an internal combustion engine, said exhaust duct having an end portion having an inlet end and a distal end, said distal end having a plurality of stationary walls and an adjustable pivot member forming an adjustable nozzle-shaped discharge outlet for exhaust gases, and variable force means for said adjustable pivot member connected between said adjustable pivot member and said stationary walls for exerting a pivoting force on said adjustable pivot member to decrease said cross section area of said adjustable nozzle-shaped discharge outlet, whereby said pivoting force decreases as said cross section area of said adjustable nozzle-shaped discharge outlet increases so that adjustable pivot member operates to pass the exhaust gases through said adjustable nozzle-shaped discharge outlet at a high discharge velocity independently of the operating speed of the internal combustion engine providing the exhaust gases.

17. An exhaust system as set forth in claim 16 wherein said end portion of said exhaust duct has a substantially oval cross section and the maximum cross section area of said discharge outlet has its major dimension aligned with the direction of movement of said adjustable pivot member and the minimum cross section area of said discharge outlet has its major dimension perpendicular to the direction of movement of said adjustable pivot member.

18. An exhaust duct for exhaust gases discharged from an internal combustion engine, said exhaust duct having a first portion with an inlet end and an outlet end and a second portion having an inlet end in flow communication with said outlet end of said first portion and a distal end, said distal end having means forming an adjustable nozzle-shaped discharge outlet for exhaust gases, adjustment means for said means forming said adjustable nozzle-shaped discharge outlet to vary the cross section area of said adjustable nozzle-shaped discharge outlet, whereby said adjustment means operates to pass the exhaust gases through said adjustable nozzle-shaped discharge outlet at a high discharge velocity independently of the operating speed of the internal combustion engine providing the exhaust gases and ball joint means located between said first portion of said exhaust duct and said second portion of said exhaust duct for pivotally connecting said first portion of said exhaust duct to said second portion of said exhaust duct, whereby exhaust gases exiting from said adjustable nozzle-shaped discharge outlet are directed in a desired direction by pivoting said second portion of said exhaust duct relative to said first portion of said exhaust duct to locate said discharge outlet in a desired direction.

* * * * *